US009452632B2

(12) United States Patent
Burtch

(10) Patent No.: US 9,452,632 B2
(45) Date of Patent: Sep. 27, 2016

(54) COUPON ENVELOPE WITH COUPON

(71) Applicant: Richard Burtch, Dallas, TX (US)

(72) Inventor: Richard Burtch, Dallas, TX (US)

( * ) Notice: Subject to any disclaimer, the term of this patent is extended or adjusted under 35 U.S.C. 154(b) by 0 days.

(21) Appl. No.: 13/941,606

(22) Filed: Jul. 15, 2013

(65) Prior Publication Data

US 2014/0021245 A1 Jan. 23, 2014

Related U.S. Application Data

(60) Provisional application No. 61/674,174, filed on Jul. 20, 2012.

(51) Int. Cl.
*B31B 1/14* (2006.01)
*B42D 15/04* (2006.01)

(52) U.S. Cl.
CPC ..... *B42D 15/045* (2013.01)

(58) Field of Classification Search
CPC ..... B65D 27/34
USPC ..... 229/70, 313, 314, 316, 92.1; 462/64, 462/65; 283/103, 105, 116; 493/227, 231
See application file for complete search history.

(56) References Cited

U.S. PATENT DOCUMENTS 3,374,940 A * 3/1968 Allison ..... 229/70
3,379,363 A * 4/1968 Sutphen, Jr. ..... 206/449
3,426,961 A * 2/1969 Allison ..... 229/70
3,512,780 A * 5/1970 Allison ..... 273/139
3,606,138 A * 9/1971 Allison ..... 229/70
3,941,307 A * 3/1976 Van Malderghem .. B65D 27/06 229/313
3,998,138 A * 12/1976 Walters ..... B42D 15/08 229/92.1
4,033,611 A * 7/1977 Johnsen ..... 283/101
4,703,933 A * 11/1987 Cahill et al. ..... 273/139
4,747,535 A * 5/1988 Haase et al. ..... 229/69
5,125,689 A * 6/1992 Heninger ..... 283/106

FOREIGN PATENT DOCUMENTS

DE 102005014587 * 9/2006 ..... B31B 41/00
DE 102005014587 A1 * 9/2006 ..... B31B 41/00

OTHER PUBLICATIONS

Machine translation of German Document No. 10 2005 014 587. Translated on Nov. 26, 2014.*

* cited by examiner

*Primary Examiner* — Jes F Pascua
(74) *Attorney, Agent, or Firm* — Heer Law; Christopher D. Heer

(57) ABSTRACT

A coupon envelope with an enclosed coupon is provided. The coupon envelope has three sections. Each section has a first side and a second side. The first and second sections each have an upper portion, a lower portion, a cut separating the two portions, and a nick connecting the two portions. The third section has a coupon portion, an upper portion, a lower portion, a cut separating the three portions, an upper nick connecting the coupon portion and the upper portion, and a lower nick connecting the coupon portion and the lower portion. The coupon envelope also has a second side attachment and a first side attachment. The second side attachment attaches the second side of the third section to the second side of the second section. The first side attachment attaches the first side of the third section to the second side of the first section.

24 Claims, 10 Drawing Sheets

COUPON ENVELOPE WITH COUPON

CROSS-REFERENCE TO RELATED APPLICATIONS

This application relates to, and claims the benefit of the filing date of, co-pending U.S. provisional patent application Ser. No. 61/674,174 entitled COUPON ENVELOPE WITH COUPON, filed Jul. 20, 2012. The entire contents of application Ser. No. 61/674,174 are incorporated herein by reference for all purposes.

TECHNICAL FIELD

This application relates to envelopes and, more particularly, to envelopes for promotional materials.

BACKGROUND

In brand recognition campaigns, businesses seek to create brand awareness of certain products or services. Frequently, businesses distribute promotional coupons, such as prize tickets, which the recipients may redeem for benefits, such as discounts or free products or services. For example, a business may distribute coupons which the recipients may redeem for a discount on a coffee purchase or free coffee. It would be desirable if promotional coupons could be enclosed in an envelope shaped like the product, service, or brand being promoted.

Sometimes, a business may wish to distribute a variety of coupons with different benefits, potentially including coupons with no benefits at all. An aspect of this type of promotion is surprising the recipient as to which coupon has been received. It would be desirable if the coupons could be distributed while enclosed in a sleeve or other envelope. It would also be desirable if the envelope were completely sealed, so that the recipient must break the seal to reveal the coupon.

Often, a brand awareness campaign requires a high volume of coupons to be produced and distributed. It would be desirable if the envelope and coupon could be constructed together, so that the coupon need not separately be placed within the envelope.

SUMMARY

In one aspect, a coupon envelope with an enclosed coupon is provided. The coupon envelope has a first section, a second section, and a third section. Each section has a first side and a second side. The first and second sections each have an upper portion, a lower portion, a cut separating the two portions, and a nick connecting the two portions. The third section has a coupon portion, an upper portion, a lower portion, a cut separating the three portions, an upper nick connecting the coupon portion and the upper portion, and a lower nick connecting the coupon portion and the lower portion. The coupon envelope also has a second side attachment and a first side attachment. The second side attachment attaches the second side of the third section to the second side of the second section. The first side attachment attaches the first side of the third section to the second side of the first section.

In another aspect, a method of constructing a coupon envelope with an enclosed coupon is provided. A card is divided into a first section, a second section, and a third section. Each section has a first side and a second side. The first section is cut into a first upper portion and a first lower portion, the two portions remaining connected by at least one nick in the first section. The second section is cut into a second upper portion and a second lower portion, the two portions remaining connected by at least one nick in the second section. The third section is cut into a coupon portion, a third upper portion, and a third lower portion. The coupon portion and the third upper portion remain connected by at least one upper nick in the third section. The coupon portion and the third lower portion remain connected by at least one lower nick in the third section. The second side of the third section is attached to the second side of the second section. The first side of the third section is attached to the second side of the first section.

DESCRIPTION OF DRAWINGS

For a more complete understanding of the present invention and the advantages thereof, reference is now made to the following Detailed Description taken in conjunction with the accompanying drawings, in which.

DETAILED DESCRIPTION

In the following discussion, numerous specific details are set forth to provide a thorough explanation. However, such specific details are not essential. Additionally, for the most part, specific details within the understanding of persons of ordinary skill in the relevant art have been omitted.

Referring to FIGS. 1-9, a coupon envelope, including the enclosed coupon, may be made from a single rectangular card. The card may be cut out from a larger card using a steel rule cutting die. Views 100A-900A show one side of the card, which may be referred to as side A. Views 100B-900B show the other side of the card, which may be referred to as side B. Views 100B-900B show the card flipped horizontally with respect to its position in views 100A-900A.

Figure 1:
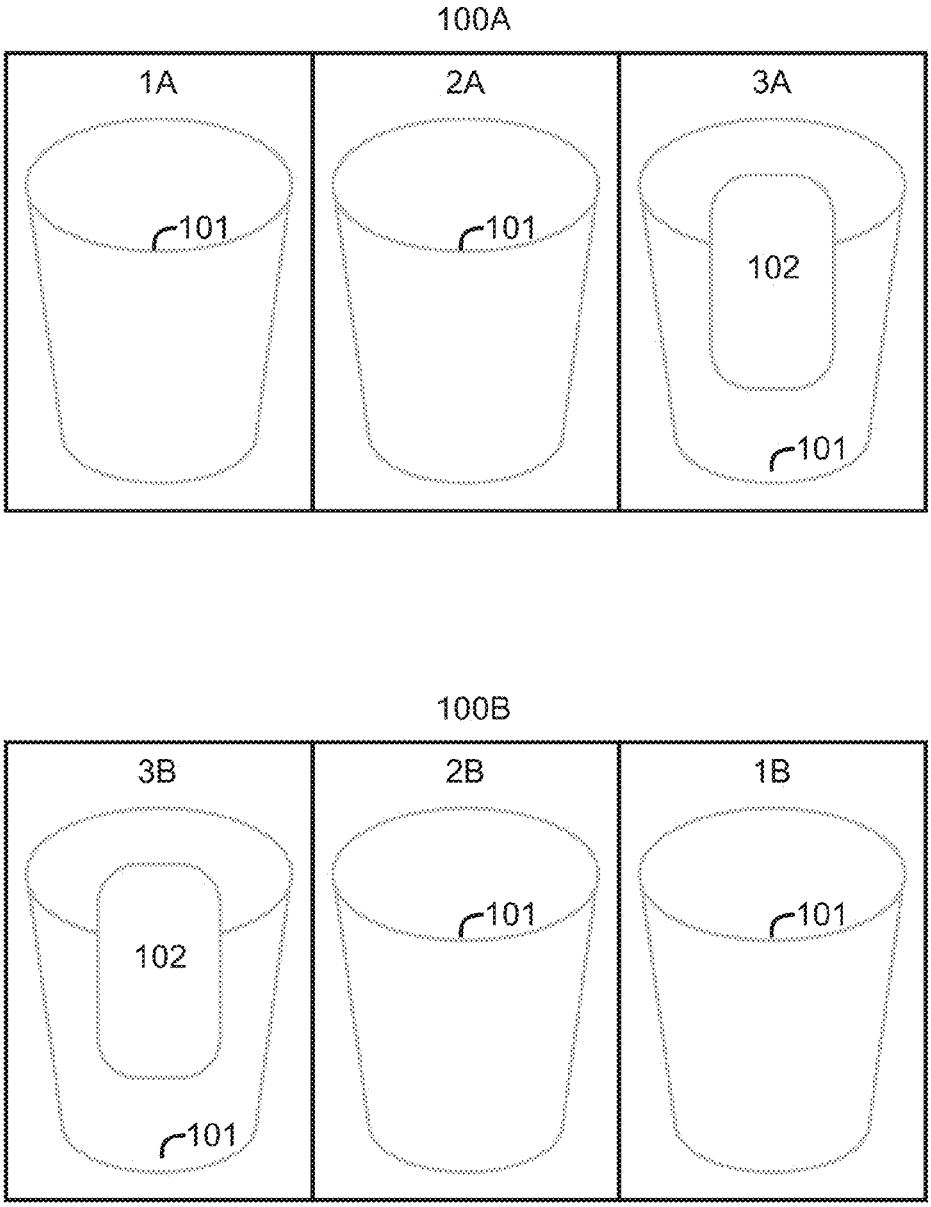
FIGS. 1-8 depict views of various steps in the construction of a coupon envelope in accordance with an exemplary embodiment of the present invention.

Referring to views 100A and 100B in FIG. 1, the card may be divided into three sections numbered 1, 2, and 3. Each section has one side on side A and one side on side B. In the drawings, reference numbers 1A and 1B respectively refer to sides A and B of section 1, reference numbers 2A and 2B respectively refer to sides A and B of section 2, and reference numbers 3A and 3B respectively refer to sides A and B of section 3.

In this discussion, the dimension of the card extending across sections 1, 2, and 3 is assumed to be the length of the card, as is shown in the drawings. However, this dimension could also be the width of the card if desired for the shape of the coupon envelope.

When the coupon envelope is completed, section 3 may be folded between section 1 and section 2. It is therefore preferable that sections 1 and 2 consume substantially equal portions of the length of the card. It is also preferable that section 3 consume a slightly smaller portion of the length so that section 3 will fit between sections 1 and 2. In some embodiments, section 3 may consume 98% of the length of the card consumed by each of sections 1 and 2. Fold lines dividing the sections may be produced with a steel rule cutting die.

As one example of possible dimensions, a card may be 4⅜th inches wide and 8 15/16th inches long. Sections 1 and 2 may be 3 inches wide and section 3 may be 2 15/16th inches wide. As another example of possible dimensions, a card may be 9 inches wide and 9 5/16th inches long. Sections 1 and 2 may be 3⅛th inches wide and section 3 may be 3 1/16th inches wide.

An image may be printed on the coupon envelope, to be later cut out from the excess card surrounding it. The example card envelope in FIGS. 1-8 has a coffee cup image 101 printed on it, as represented by the gray outline. Other card envelopes may have other images printed on them, such as a beer bottle. The coupon 102 may also be printed on the card as a portion of section 3.

When the coupon envelope is completed, only side A of section 1 and side A of section 2 face outward. Thus, printing the image 101 on other sides and sections may be unnecessary. Nonetheless, in the drawings the image 101 is shown on both sides of all sections for reference. Different images may be used on different sides and sections. For example, image 101 may appear on side A of section 1 and a different image may appear on side A of section 2.

Figure 2:
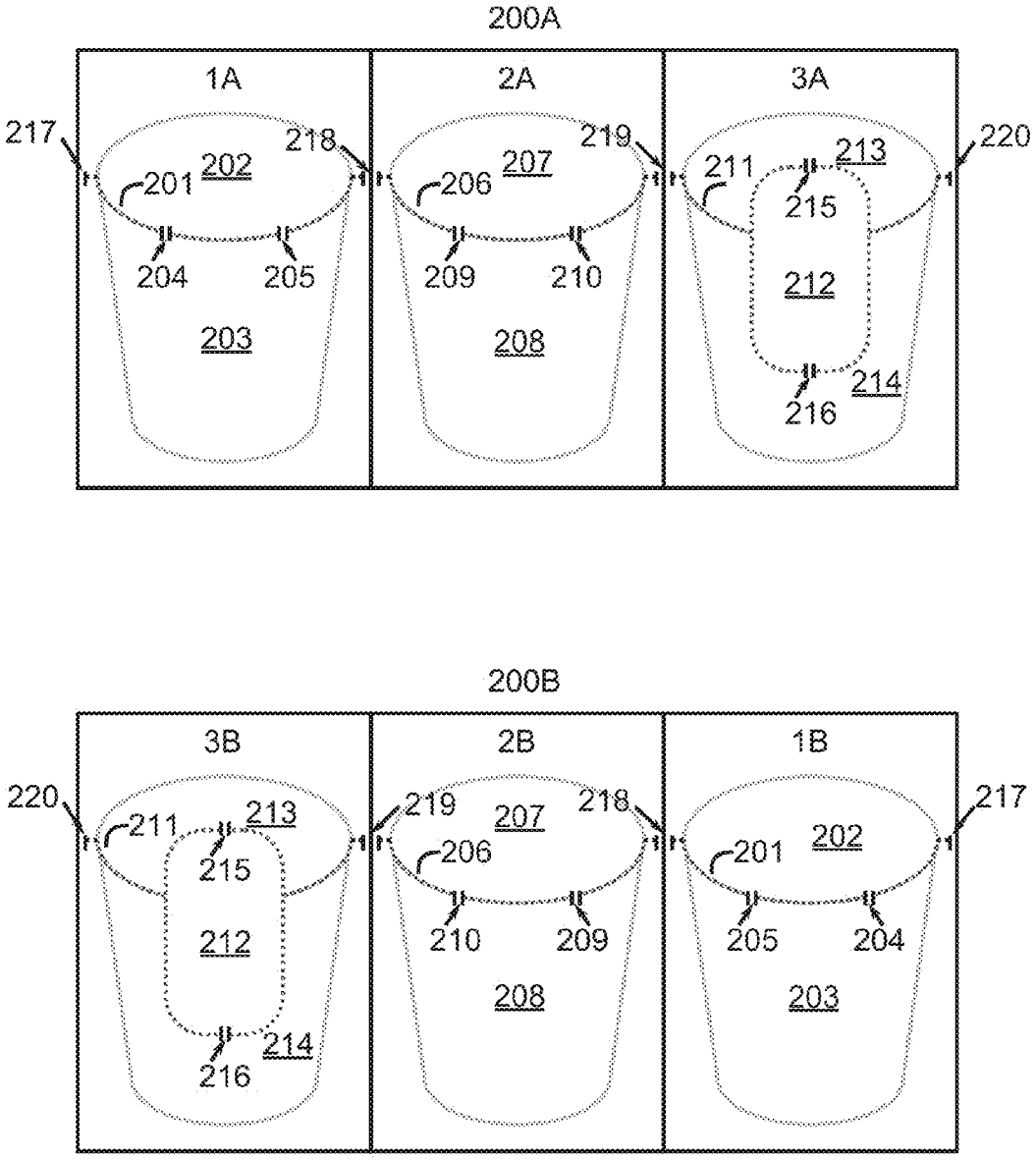

Referring to views 200A and 200B in FIG. 2, section 1 may receive cut 201, denoted by a dotted line, to divide the section into an upper portion 202 and a lower portion 203. Cut 201 is interrupted by "nicks" 204 and 205. A nick is a break in a cut which leaves a thin connection between the two sides of the cut. Section 2 may receive a substantially identical cut 206, also denoted by a dotted line, to divide section 2 into an upper portion 207 and a lower portion 208. Similar to cut 201, cut 204 is interrupted by nicks 209 and 210.

Section 3 may receive cut 211. Unlike cuts 201 and 204, cut 211 divides section 3 into three portions: a coupon portion 212, an upper portion 213, and a lower portion 214. Nick 215 connects upper portion 213 to coupon portion 212, and nick 216 connects coupon portion 212 to lower portion 216.

One method for creating a nick is to use a grinding disk to grind a gap into a steel rule cutting die. When the cutting die makes a cut in the card, the portion of the card at the gap is spared. Typically, a nick is between one-half and one millimeter. Nicks of different widths can be created by using grinding disks of different widths.

Cuts 201, 206, and 211 may not extend across the entire widths of their respective sections. Instead, bridges 217, 218, 219, and 220 may remain to hold the various portions 202, 203, 207, 208, 213, and 214 together in addition to the nicks. In the drawings, a solid vertical line denotes the border between a cut and a bridge. Bridges 218 and 219 may extend laterally across, spanning the longitudinal fold lines shown running vertically from top to bottom of the card. The bridges 217, 218, 219, and 220 may hold the upper portions 202, 207 and 213 of the card against separation from lower portions 203 208, and 214, during at least a portion of the manufacturing process and possibly until the desired shape of the image, for example, is cut. Bridge 217 may hold the upper and lower portions 202, 203 of section 1 together, bridge 218 may hold the upper and lower portions 202, 203, 207 and 208 of sections 1 and 2 together, bridge 219 may hold the upper and lower portions 207, 208, 213 and 214 of sections 2 and 3 together, and bridge 220 may hold the upper and lower portions 213 and 214 of section 3 together. The bridges may subsequently be cut away as described below with reference to FIG. 9.

Cuts 201 and 204 are curved to match the lid of the coffee cup in the image, so that upper portions 202 and 207 include the lid of the cup and lower portions 203 and 208 include the remainder of the cup. This curvature is arbitrary; another coupon envelope could have cuts 201 and 204 dividing the upper and lower portions in a different manner. However, cuts 201 and 204 are preferably identical. Cut 211 is also preferably identical to cuts 201 and 204, except that cut 211 should cut around the coupon portion 212, and nicks 215 and 216 should respectively attach upper portion 213 to coupon portion 212 and coupon portion 212 to lower portion 214. Additionally, only two nicks are used in each section in the embodiment shown, but more or fewer nicks could be used depending on the size of the envelope.

Figure 3:
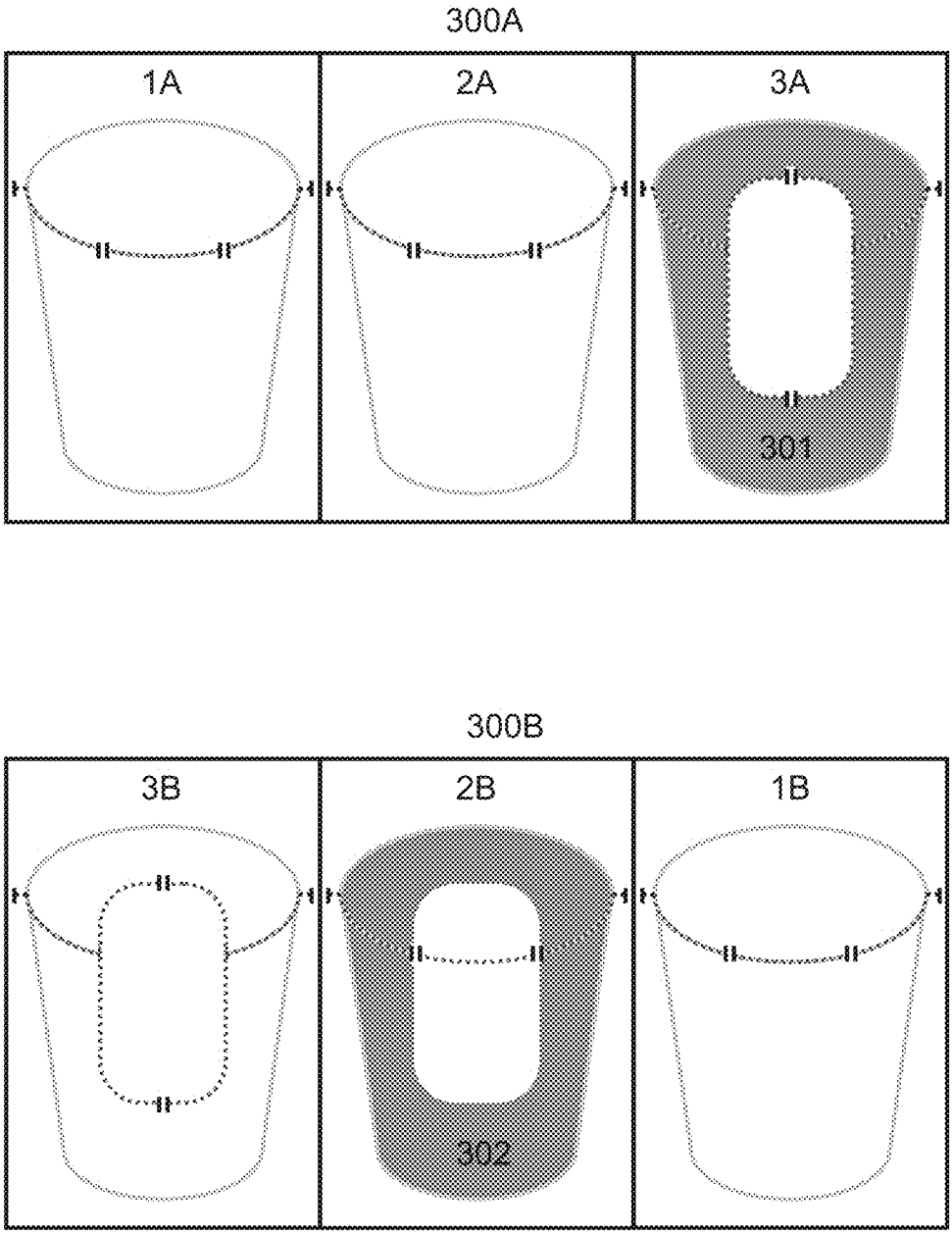

Referring to views 300A and 300B in FIG. 3, side A of section 3 may have a layer of glue 301 applied to it. Side B of section 2 may have layer of glue 302 applied to it. Layer of glue 301 may be limited to the interior of image, excluding the coupon itself. Layer of glue 302 may likewise be limited to the interior of the image, excluding the portion of section 2 which will come into contact with the coupon when the card is folded as shown in views 400A and 400B.

Figure 4:
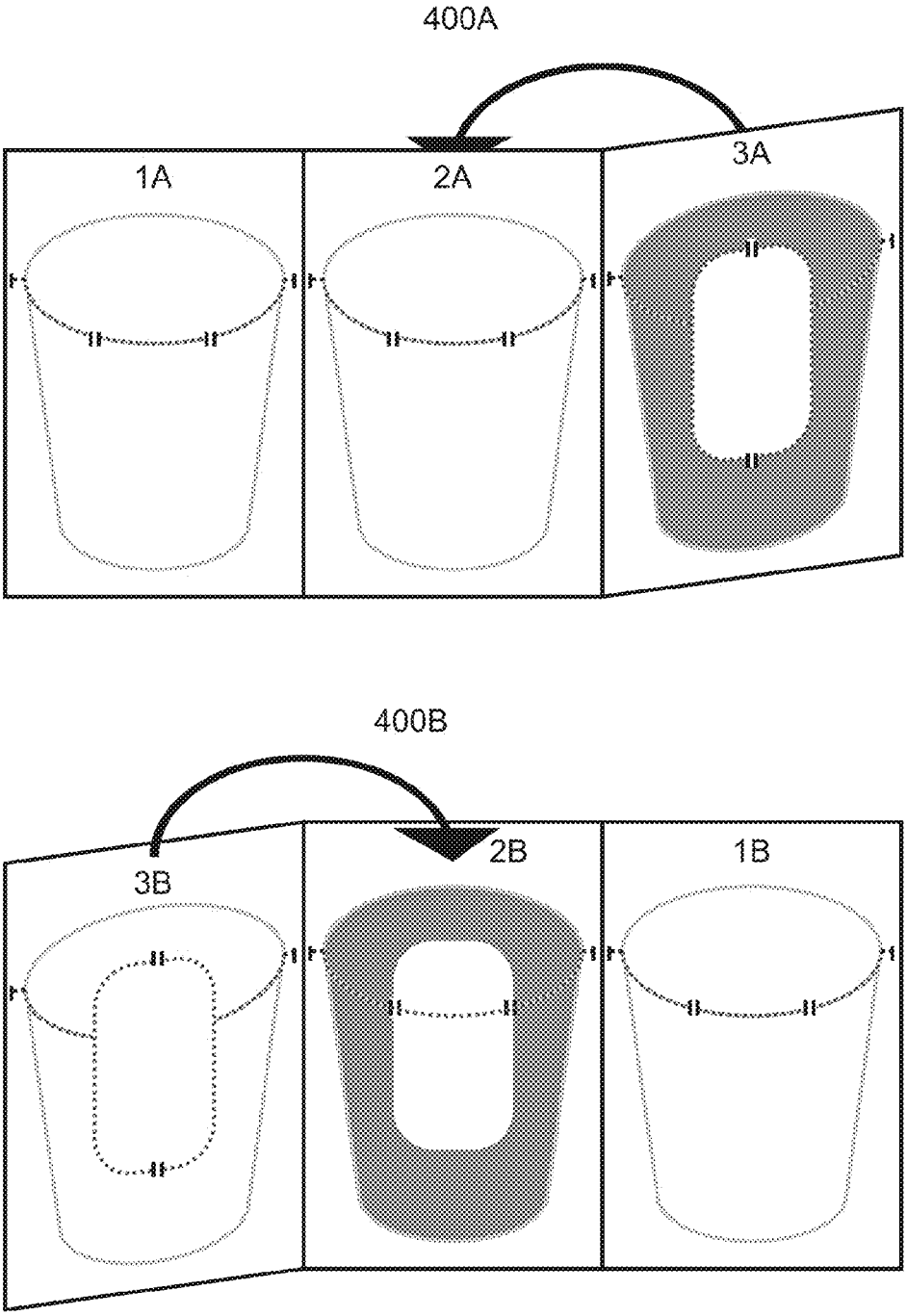
Figure 5:
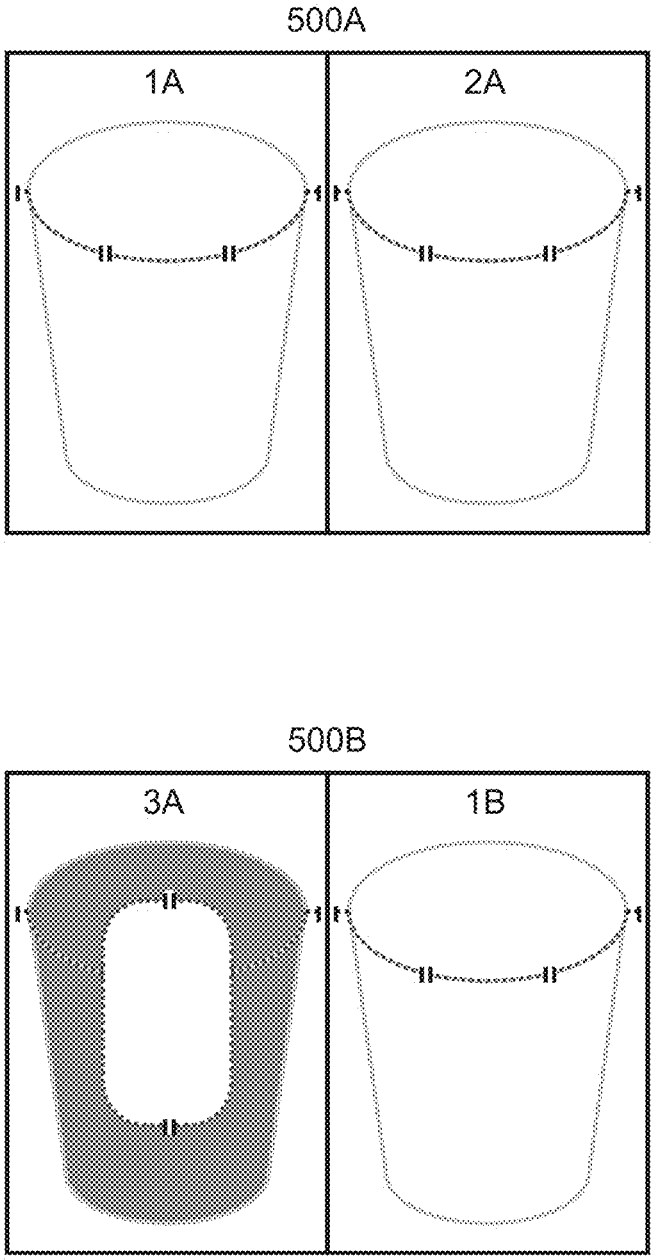
Figure 6:
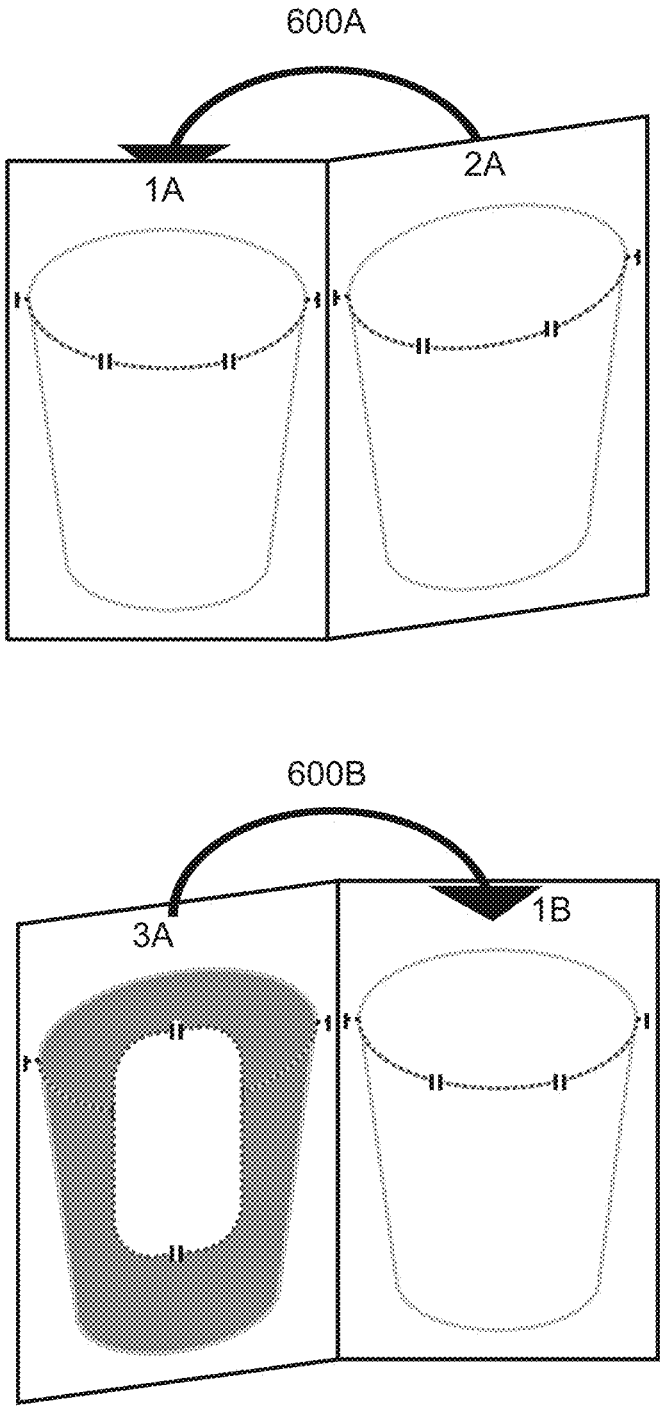
Figure 7:
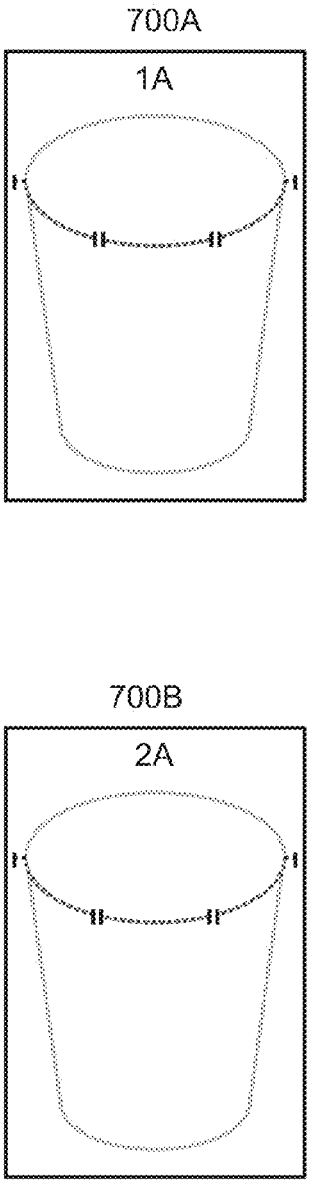

Referring to views 400A and 400B in FIG. 4, side B of section 3 may be folded against side B of section 2. Referring to views 500A and 500B in FIG. 5, layer of glue 302 may hold sections 2 and 3 together. Referring to views 600A and 600B in FIG. 6, side A of section 3 may be folded against side B of section 1. Referring to views 700A and 700B in FIG. 7, layer of glue 301 may hold sections 1 and 3 together.

Figure 8:
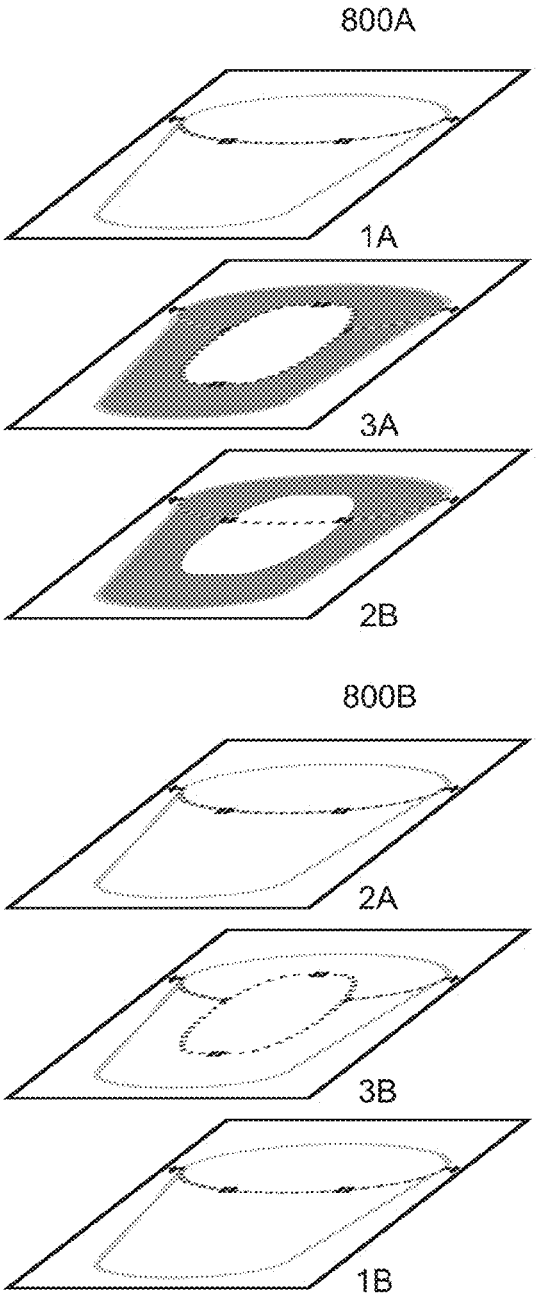

Referring to view 800A in FIG. 8, when the folded coupon envelope is placed face up side A of section 1 is on top, followed by side A of section 3, and then side B of section 2. Referring to view 800B, when the folded coupon envelope is placed face down, side A of section 2 is on top, followed by side B of section 3, and then side B of section 1.

Figure 9:
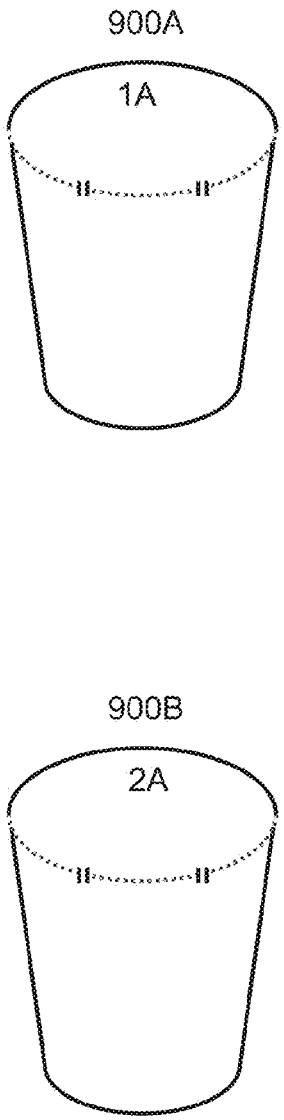
FIG. 9 depicts a completed coupon envelope in accordance with an exemplary embodiment of the present invention.

Referring to views 900A and 900B in FIG. 9, the excess card around the image may be cut away, leaving a completed coupon envelope in the shape of the image. This cutting may be performed with a hollow ground die. This form of cutting is sometimes called PMC die-cutting after a commonly used "PMC" brand of die cutter.

In section 1, upper portion 202 and lower portion 203 are held together only by nicks 204 and 205. Likewise, in section 2, upper portion 207 and lower portion 208 are held together only by nicks 209 and 210. In section 3, upper portion 213 and coupon portion 212 may be held together by nick 215, and coupon portion 212 and lower portion 214 may be held together by nick 216. The layer of glue on side A of section 3 holds sections 1 and 3 together. The layer of glue on side B of section 2 holds sections 2 and 3 together.

Figure 10:
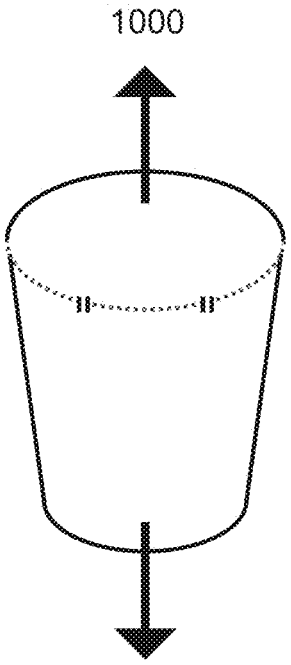
FIGS. 10-13 depict various steps in the opening of a coupon envelope in accordance with an exemplary embodiment of the present invention.
Figure 11:
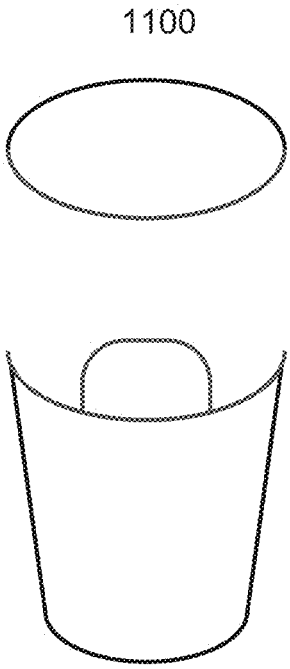

Referring to view 1000 in FIG. 10, coupon portion 212, the coupon, may be retrieved from the completed coupon envelope by pulling upper portions 202, 207, and 213 and lower portions 203, 208, and 214 apart. Referring to view 1100 in FIG. 11, all nicks 204, 205, 209, and 210 in sections 1 and 2 may separate, along with one of the nicks 215 or 216 in section 3. Coupon portion 212 may thus be attached to the coupon envelope only by the remaining nick 215 or 216 in section 3. In the drawings, it is assumed nick 215 separated, leaving coupon portion 212 attached only by nick 216.

Figure 12:
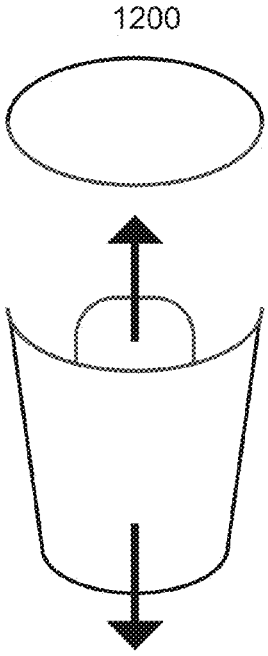
Figure 13:
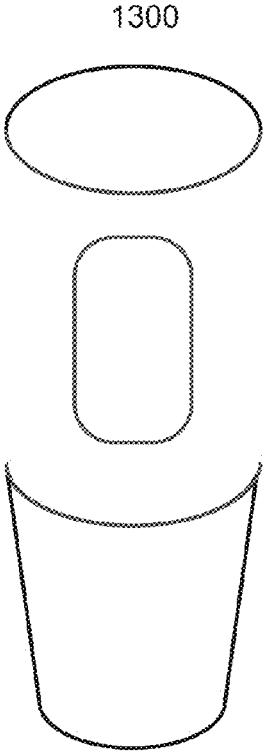

Referring to view 1200 in FIG. 12, coupon portion 212 may be pulled away from the remaining portion of the coupon envelope it is attached to, until the remaining nick separates. Referring to view 1300 in FIG. 13, coupon portion 212 will then be separate from both the upper portions 202, 207, and 213 and the lower portions 203, 208, and 214 of the coupon envelope.

In one alternative embodiment of the production of the coupon envelope, the excess card around the image may be cut away as described with reference to FIG. 9 prior to the cuts dividing the sections into portions as described with reference to FIG. 2. However, this approach removes the bridges 217, 218, 219, and 220 holding the upper and lower portions together during other steps in the manufacturing.

It is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of various embodiments.

The invention claimed is:

1. A method of constructing a coupon envelope with an enclosed coupon, the method comprising:

dividing a card into a first section, a second section, and a third section, wherein each of the first section, the second section, and the third section has a first side and a second side;

cutting the first section into a first upper portion and a first lower portion, the first upper portion and the first lower portion remaining connected by at least one nick in the first section;

cutting the second section into a second upper portion and a second lower portion, the second upper portion and the second lower portion remaining connected by at least one nick in the second section;

cutting the third section into a coupon portion, a third upper portion, and a third lower portion, the coupon portion and the third upper portion remaining connected by at least one upper nick in the third section, the coupon portion and the third lower portion remaining connected by at least one lower nick in the third section;

attaching the second side of the third section to the second side of the second section; and attaching the first side of the third section to the second side of the first section;

wherein at least one bridge between the third upper portion and the third lower portion remains after the cutting of the third section; and further comprising removing the at least one bridge between the third upper portion and the third lower portion.

2. The method of claim 1, wherein the first section and the second section consume substantially equal portions of a dimension of the card extending across the first, second, and third sections.

3. The method of claim 2, wherein the dimension extending across the first, second, and third sections is the length of the card.

4. The method of claim 1, wherein the third section consumes a smaller portion of a dimension extending across the first, second, and third sections than either of the first or second sections.

5. The method of claim 4, wherein the dimension extending across the first, second, and third sections is the length of the card.

6. The method of claim 1, wherein the second section is between the first section and the third section when the card is divided.

7. The method of claim 1, wherein the cutting of the second section comprises making a cut substantially identical to a cut made in the cutting of the first section.

8. The method of claim 1, further comprising printing an image on the first side of the first section and printing an image on the first side of the second section.

9. The method of claim 1, wherein at least one bridge between the second upper portion and the second lower portion remains after the cutting of the second section.

10. The method of claim 9, further comprising removing the at least one bridge between the second upper portion and the second lower portion.

11. The method of claim 1, wherein:

the attaching the second side of the third section to the second side of the second section comprises folding the second side of the third section against the second side of the second section; and the attaching the first side of the third section to the second side of the first section comprises folding the first side of the third section against the second side of the first section.

12. The method of claim 11, wherein:

the folding the second side of the third section against the second side of the second section causes a layer of glue to attach the second side of the third section to the second side of the second section; and the folding the first side of the third section to the second side of the first section causes a layer of glue to attach the first side of the third section to the second side of the first section.

13. The method of claim 12, wherein the layer of glue attaching the second side of the second section to the second side of the third section does not contact the coupon portion.

14. A method of constructing a coupon envelope with an enclosed coupon, the method comprising:

dividing a card into a first section, a second section, and a third section, wherein each of the first section, the second section, and the third section has a first side and a second side;

cutting the first section into a first upper portion and a first lower portion, the first upper portion and the first lower portion remaining connected by at least one nick in the first section;

cutting the second section into a second upper portion and a second lower portion, the second upper portion and the second lower portion remaining connected by at least one nick in the second section;

cutting the third section into a coupon portion, a third upper portion, and a third lower portion, the coupon portion and the third upper portion remaining connected by at least one upper nick in the third section, the coupon portion and the third lower portion remaining connected by at least one lower nick in the third section;

attaching the second side of the third section to the second side of the second section; and attaching the first side of the third section to the second side of the first section;

wherein at least one bridge between the first upper portion and the first lower portion remains after the cutting of the first section and wherein at least one bridge between the second upper portion and the second lower portion remains after the cutting of the second section and wherein at least one bridge between the third upper portion and the third lower portion remains after the cutting of the third section; and further comprising removing the at least one bridge between the first upper portion and the first lower portion, removing the at least one bridge between the second upper portion and the second lower portion and removing the at least one bridge between the third upper portion and the third lower portion.

15. The method of claim 14, wherein the first section and the second section consume substantially equal portions of a dimension of the card extending across the first, second, and third sections.

16. The method of claim 15, wherein the dimension extending across the first, second, and third sections is the length of the card.

17. The method of claim 14, wherein the third section consumes a smaller portion of a dimension extending across the first, second, and third sections than either of the first or second sections.

18. The method of claim 17, wherein the dimension extending across the first, second, and third sections is the length of the card.

19. The method of claim 14, wherein the second section is between the first section and the third section when the card is divided.

20. The method of claim 14, wherein the cutting of the second section comprises making a cut substantially identical to a cut made in the cutting of the first section.

21. The method of claim 14, further comprising printing an image on the first side of the first section and printing an image on the first side of the second section.

22. The method of claim 14, wherein:

the attaching the second side of the third section to the second side of the second section comprises folding the second side of the third section against the second side of the second section; and the attaching the first side of the third section to the second side of the first section comprises folding the first side of the third section against the second side of the first section.

23. The method of claim 22, wherein:

the folding the second side of the third section against the second side of the second section causes a layer of glue to attach the second side of the third section to the second side of the second section; and the folding the first side of the third section to the second side of the first section causes a layer of glue to attach the first side of the third section to the second side of the first section.

24. The method of claim 23, wherein the layer of glue attaching the second side of the second section to the second side of the third section does not contact the coupon portion.

* * * * *